United States Patent [19]

LaRochelle

[11] Patent Number: 4,628,972

[45] Date of Patent: Dec. 16, 1986

[54] APPARATUS FOR RECONDITIONING DRUMS

[75] Inventor: Fernand LaRochelle, Portland, Me.

[73] Assignee: H. Daniel Doane, Peaks Island, Me.

[21] Appl. No.: 735,124

[22] Filed: May 17, 1985

Related U.S. Application Data

[63] Continuation of Ser. No. 524,189, Aug. 18, 1983, abandoned.

[51] Int. Cl.[4] ..... B67C 1/047; B65B 43/60; B08B 9/12

[52] U.S. Cl. ..... 141/91; 141/98; 141/168; 141/171; 141/250; 134/43; 134/133; 134/72 R; 198/388

[58] Field of Search ..... 141/89–92, 141/98, 94, 129, 156–158, 165, 168, 171, 172, 181, 250–263, 269–274; 134/43, 61, 62, 71, 72, 78, 133, 134, 137, 140, 151, 172; 198/388, 412, 413

[56] References Cited

U.S. PATENT DOCUMENTS

| | | | |
|---|---|---|---|
| 1,298,489 | 3/1919 | Frelinghuysen et al. | 134/43 |
| 2,023,432 | 10/1935 | McClatchie | 198/412 |
| 2,085,936 | 7/1937 | Wolf | 198/412 X |
| 2,115,202 | 4/1938 | Kimball | 141/6 |
| 2,115,204 | 4/1938 | Kimball | 134/144 |
| 2,147,247 | 2/1939 | Doty et al. | 141/6 |
| 2,845,934 | 8/1958 | Payson | 134/56 |
| 3,348,555 | 10/1967 | Thomas | 134/43 |
| 3,419,147 | 12/1968 | Corby | 134/62 X |
| 3,615,822 | 10/1971 | Molinari | 134/43 |
| 4,018,026 | 4/1977 | Kamisaka et al. | 141/165 |
| 4,143,759 | 3/1979 | Paradis | 198/688 |
| 4,494,583 | 1/1985 | Reeves, Jr. et al. | 141/83 |
| 4,520,853 | 6/1985 | Niese et al. | 141/168 |

FOREIGN PATENT DOCUMENTS

| | | | |
|---|---|---|---|
| 155599 | 9/1951 | Australia | 198/412 |
| 615013 | 7/1978 | U.S.S.R. | 198/412 |

OTHER PUBLICATIONS

The Portland Co. brochure "Portco Drum Rinsers and Drum Reconditioners".

The Richmond Co. brochure "Semi Autom. Pre-Flusher".

*Primary Examiner*—Stephen Marcus

*Assistant Examiner*—Ernest G. Cusick

[57] ABSTRACT

Apparatus for reconditioning drums has a conveyor extending through a series of equally spaced stations. The conveyor has a series of members, each in the form of a forwardly opening V and with the members so spaced that when any one is at a station, other members will be at the other stations. Drums are placed, one at a time, and inverted, on the infeed end of the conveyor with the bung of each in a position to be caught and held centered by one of the members and pulled thereby along the center line of the conveyor. The conveyor is moved by steps with each step advancing a conveyed drum to a station at which the bung is in vertical alignment with a vertically disposed, subjacent spray nozzle. Dwells between the steps are provided of a predetermined duration during which the nozzles are elevated to an extent entering them within a drum and the drums at stations are tilted fowardly. At each station, a reconditioning fluid is discharged through the associated nozzle if a drum is in fact present. A loader and an unloader are provided to load on and unload drums from the conveyor, one at a time.

16 Claims, 16 Drawing Figures

8
8
20
21
22
23
24
24A
25
26
27
31
32
42
43
46
47
73
74
75
76
77
79
80
81
85
86
87
90
91
92
120A
120B
120C 20
21
22
23
24
24A
25
27
28
29
30
31
32
36
37
38
40
42
42A
42B
43
43A
43B
44
45
46
47
51
52
55
56
74
75
76
77
80
81
85
86
89
90
91
92
94
120A
120B
120C 43
51
52
50
24A
24A
37
69
46
47
42B
43A
52
42A
44
44
38
20
36
32
33
34
42A
40
40
39
42B
49
24
35
23

APPARATUS FOR RECONDITIONING DRUMS

This is a continuation of application Ser. No. 524,189, filed Aug. 18, 1983, now abandoned.

BACKGROUND REFERENCES

U.S. Pat. No. 2,115,202.
U.S. Pat. No. 2,115,204.
U.S. Pat. No. 2,147,247.
U.S. Pat. No. 2,240,364.
U.S. Pat. No. 2,845,934.
Publications—Brochures
The Portland Company—Portco Drum Rinsers And Drum Reconditioners.
Richmond Machine Company—Semi Auto Pre-flusher.

BACKGROUND OF THE INVENTION

Apparatus have been available for many years for use in reconditioning the interiors of drums with the term drum as used herein including barrels and other industrial containers. Drums having bungs present a problem in that they do not competely drain when inverted. It has, accordingly, been the practice to siphon residual water through the bungholes with each drum so tilted as to form a water-collecting pocket and preferably with its bung disposed upwardly. If more than one reconditioning fluid was to be used, the nozzles required appropriate valve controls and the apparatus needed corresponding drainage controls. Both requirements presented additional problems if the drums were to be conveyed while being subjected to different fluid treatments or if single stationary drums were to be subjected to more than two liquid treatments.

The semi-automatic drum pre-flusher shown in the Richmond Machine Company brochure requires the placing of the drums on a conveyor, bungs downward, each over a nozzle and held tilted. After being flushed and drained, the drums are conveyed together, all upright, from the apparatus.

The Portland Company brochure shows drum rinsers and reconditioners utilizing features substantially in accordance with those of U.S. Pats. Nos. 2,147,274, 2,240,364, and 2,845,934.

The drum rinser utilized a separate, continuously operated suction tube for use in a final drying operation after a drum was removed from the apparatus.

No reference discloses or suggests apparatus by which drums are advanced through successive stations at each of which the interior of a drum is subjected to a reconditioning fluid with each station independent of the others with respect to spray nozzles and fluid delivery means. No reference teaches or suggests the use of loaders and unloaders, manually or automatically controlled, by which drums may be loaded on and removed from the conveyor, one at a time.

THE PRESENT INVENTION

The general objective of the present invention is to provide apparatus for suitably reconditioning the interior of drums in which drums are advanced by steps from station to station in inverted positions with a dwell at each station during which any drum there present has its interior treated with the appropriate one of a plurality of reconditioning fluids.

In accordance with the invention, this general objective is attained with the apparatus having a conveyor extending through a series of stations at each of which there is a vertically reciprocable spray nozzle having a normal position below the conveyor with the nozzles aligned lengthwise thereof. The conveyor is of the endless type and is provided with regularly spaced members, each substantially in the form of a forwardly opening V dimensioned to engage and center the bung of a drum relative thereto when inverted and placed on the infeed end of the supports with its bung in a position to be engaged by the V-shaped member and pulled along the supports with each bunghole advanced along a predetermined lengthwise path in a vertical plane inclusive of the nozzles, desirably the center line of the conveyor.

The V-shaped members are so spaced that each is at a station over a nozzle when another or others are at a station over the other nozzle or nozzles and the conveyor drive is operable to advance the drums by steps with a dwell at the stations between steps. During each dwell, the spray nozzles are raised from their normal positions. Each nozzle, as it is raised enters a drum, if present at that station, through its bunghole with fluid discharged through the nozzle provided a drum is actually present. At the end of each dwell any fluid delivery is terminated and the nozzles retracted. It is preferred that all nozzles be reciprocated between their two positions if a drum is presented at any station.

For most effective cleaning of the interior, the drums are held tilted and it is preferred that such tilting be effected only during a dwell as they are best conveyed when positioned upright. To achieve that result, tilting means are provided that are reciprocated between an inoperative position below the conveyor and a raised operative position in which the drums are tilted forwardly when the nozzles are raised and in preferred constructions this result is attained by providing a rigid connection between each spray nozzle and the associated tilting means.

The interiors of drums are reconditioned by various procedures of which the most common is that of employing a washing liquid at the first station, a rinsing liquid at the second station and a final rinsing liquid at the last station with drying completed after each drum is removed from the apparatus. The apparatus, as subsequently detailed, is for use in practicing such a procedure.

Other procedures, by way of examples, require washing, rinsing and air drying; washing, rinsing followed by some other final treatment such, for example, as a steam treatment; prewashing, washing and rinsing; and a steam treatment followed by washing and rinsing.

In practice, the space below the conveyor is divided into a series of tanks, one for each station and each provided with means to deliver fluid through the associated nozzle if a drum is present at that station.

As such drums are relatively heavy, it is preferred to provide a loader at the infeed end and an unloader at the outfeed end of the conveyor.

The loader and unloader have drum holding frames pivotally mounted to swing from a drum receiving position into a discharging position. In the case of the loader, each drum is placed with its bung downward at the infeed end of the conveyor in a position to be carried forward thereby with its bung in the wanted lengthwise path. In the case of the unloader, the discharging position thereof places the drum with its bung upwardly in a position for removal.

In the case of the loader, thr frame receives a drum on its side with its bung towards the conveyor and in its discharging position, the frame holds the drum on the supports with its bung in a position to be engaged by a V-shaped member and then pulled forwardly along the path. It is a preferred feature of the loader that the frame has rollers in support of the drum and includes a stop provided with a yieldable locator engageable by the vent plug of the drum then to place the bung in a wanted position by rotating the drum in one direction or another until the vent plug engages the locator. The bung is then in a position in which, with the inverted barrel on the support, it will be engaged by a V-shaped member and brought thereby into alignment with its lengthwise path.

In the case of the unloader, the frame has a position in which a drum, discharged by the conveyor, topples against the frame with the frame provided with a stop enabling the frame to be swung through an arc until the drum rests on the floor or other support with its bung upwards.

While the loader and unloader are power operated, the operation thereof may be manually controlled or tied to the controls of the conveyor.

In order that the drums will be effectively dried when the final fluid treatment so requires, each drum (whether manually removed from the conveyor or removed by an unloader) is subjected to a further process by inserting a suction tube downwardly into a washed and rinsed barrel through its bunghole, preferably after its removal from the unloader. In practice, suction results from the use of a venturi in the pumping system for the tank at the outfeed end of the apparatus.

Other objectives and novel features of the invention will be apparent from the following description of a preferred embodiment of the invention and the appended claims.

PRIOR ART STATEMENT

Of the previously cited U.S. Pat. Nos. 2,115,202 and 2,115,204 are of interest in that they show the cleaning of the interiors of barrels supported in tilted positions, bungs downward. Spray devices and draining siphons extend upwardly through the bungs and the barrels then advanced through washing, rinsing and drying stations.

U.S. Pat. Nos. 2,147,247, 2,240,364, and 2,845,934 are of interest in that they show the cleaning and drying of barrels while supported in a tilted, fixed position with their bungs upward and with the spray nozzles including suction conduits.

In each of the above, each spray nozzle was valve controlled to enable the different fluids to pass successively therethrough.

The drum pre-flusher illustrated by the brochure of the Richmond Machine Company is of interest as showing a series of nozzles, each with associated means to hold a drum in a tilted position when placed over a nozzle with the nozzles and tilting means lowered to permit all the drums to be conveyed from the apparatus.

No other prior art is known by me that is of interest in connection with the present invention as defined by the appended claims.

BRIEF DESCRIPTION OF THE DRAWINGS

The accompanying drawings illustrate a preferred embodiment of the invention of which—

THE PREFERRED EMBODIMENT OF THE INVENTION

Figure 1:
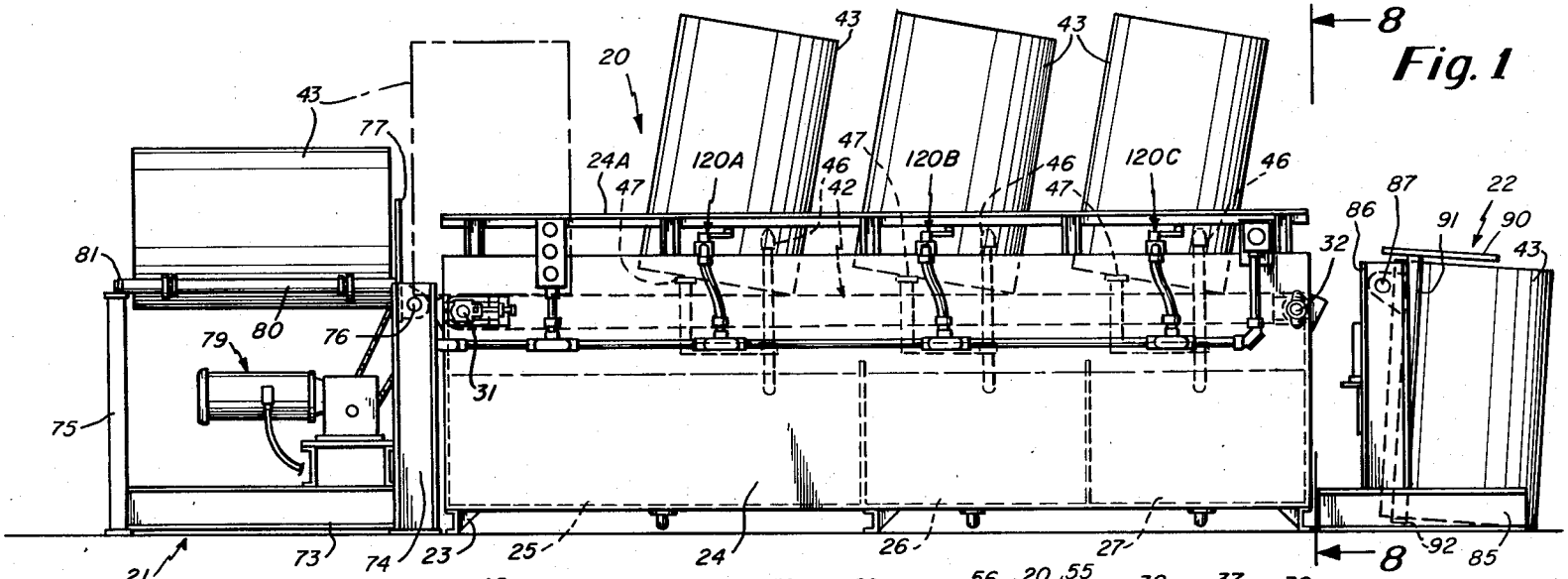
FIG. 1 is a view of one side of the drum reconditioner, the loader at the infeed end thereof, and the unloader at the outfeed end with the drums being treated during a dwell in the conveyor travel.

The apparatus illustrated by the drawings includes a drum reconditioner, generally indicated at 20, a loader, generally indicated at 21 at the infeed end of the reconditioner, and an unloader, generally indicated at 22 at the outfeed end thereof. The reconditioner is described for use when the wanted procedure is for a washing treatment followed by first and final rinses with each drum dried following its removal from the reconditioner.

The drum reconditioner 20 has a base 23 in support of a shell 24 with the base exposed along the front thereof. The shell 24 is divided to establish a series of three tanks with the tank 25 for washing liquid, the tank 26 for flusing water and the tank 27 for water for use as a final rinse. The shell 24 supports guide rails 24A spaced above its sides. The base 23 supports pump and motor units generally indicated as 28, 29, and 30 for the liquids in the tanks 25, 26, and 27, respectively.

Figure 8:
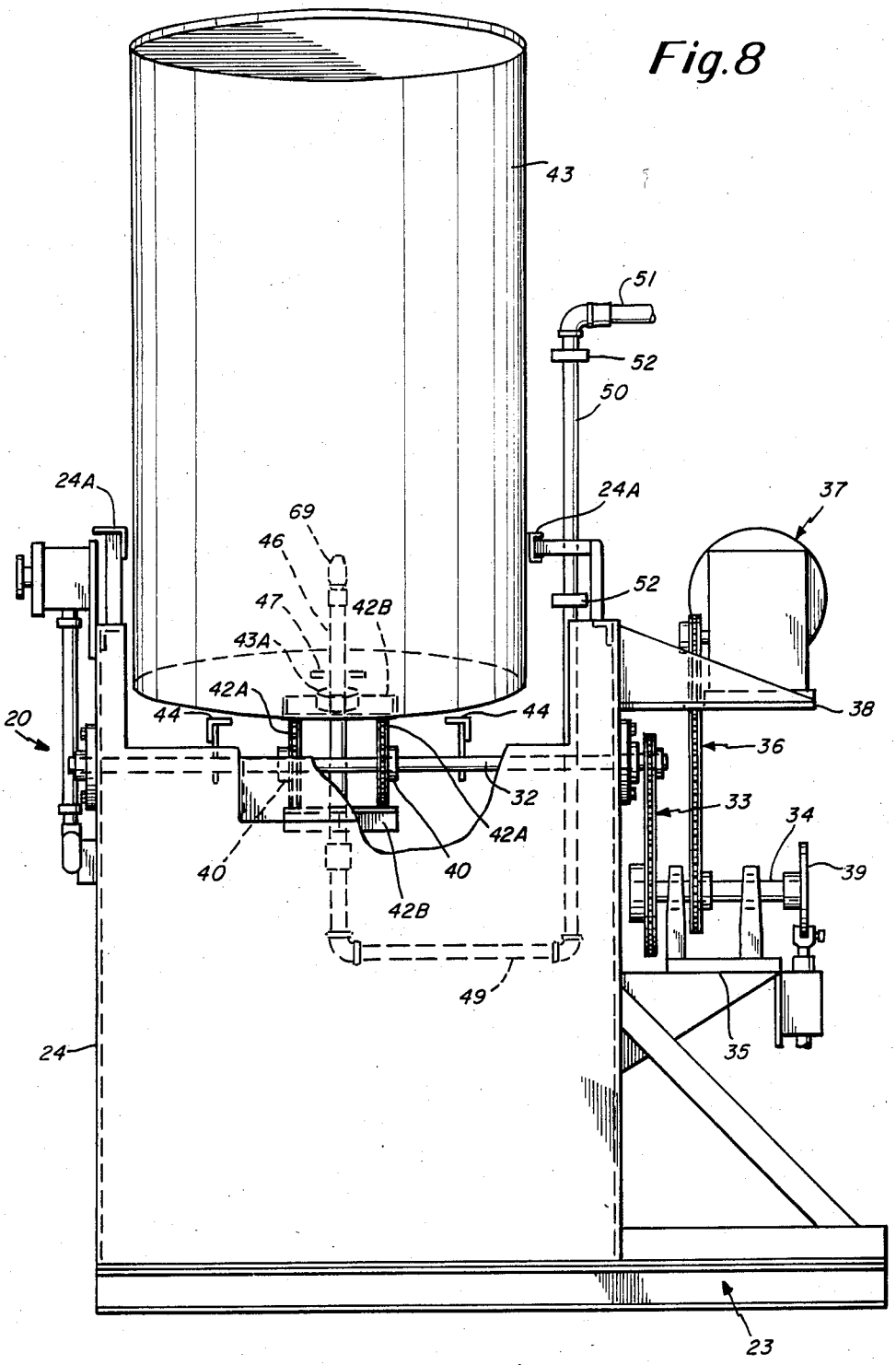
FIG. 8 is an end view of the reconditioner on an increase in scale, taken approximately along the indicated line 8—8 of FIG. 1.

The side walls of the shell 24 adjacent the ends thereof rotatably support shafts 31 and 32 with the shaft 32, see FIG. 8, extending through the front of the shell and with a chain and sprocket connection generally indicated at 33 between its exposed end and a shaft 34 rotatably mounted on a bracket 35 mounted on the front of the shell. The shaft 34 has a chain and sprocket connection, generally indicated at 36, with the drive shaft of a gear box and motor unit 37 mounted on a bracket 38. The shaft 34 has an adjustable cam 39 on its outer end the function of which will subsequently be apparent.

Figure 2:
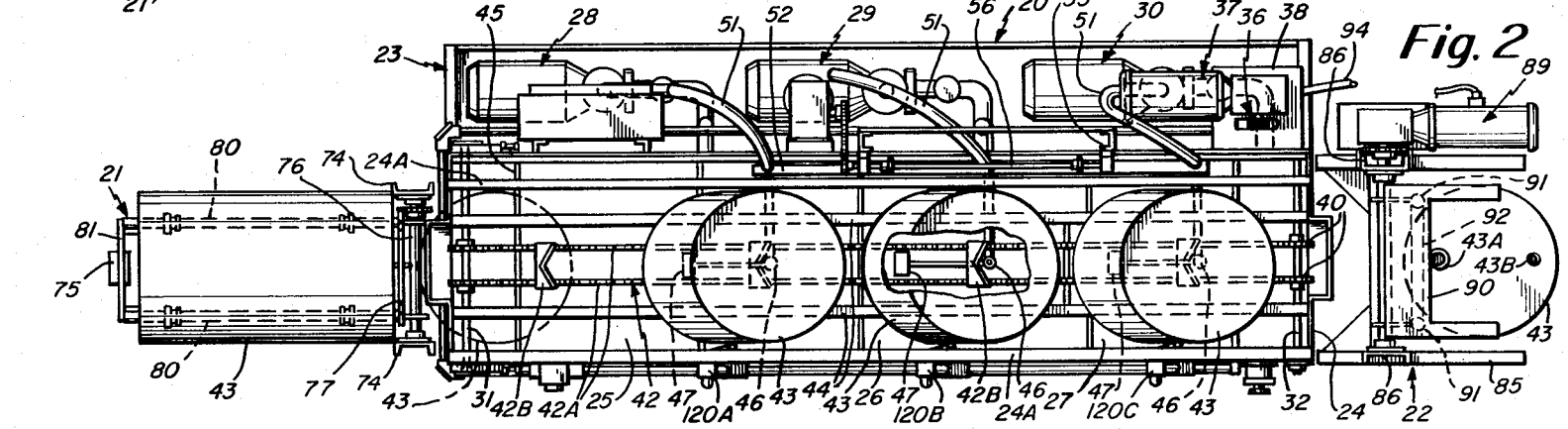
FIG. 2 is a top plan view of the apparatus as shown in FIG. 1.
Figure 3:
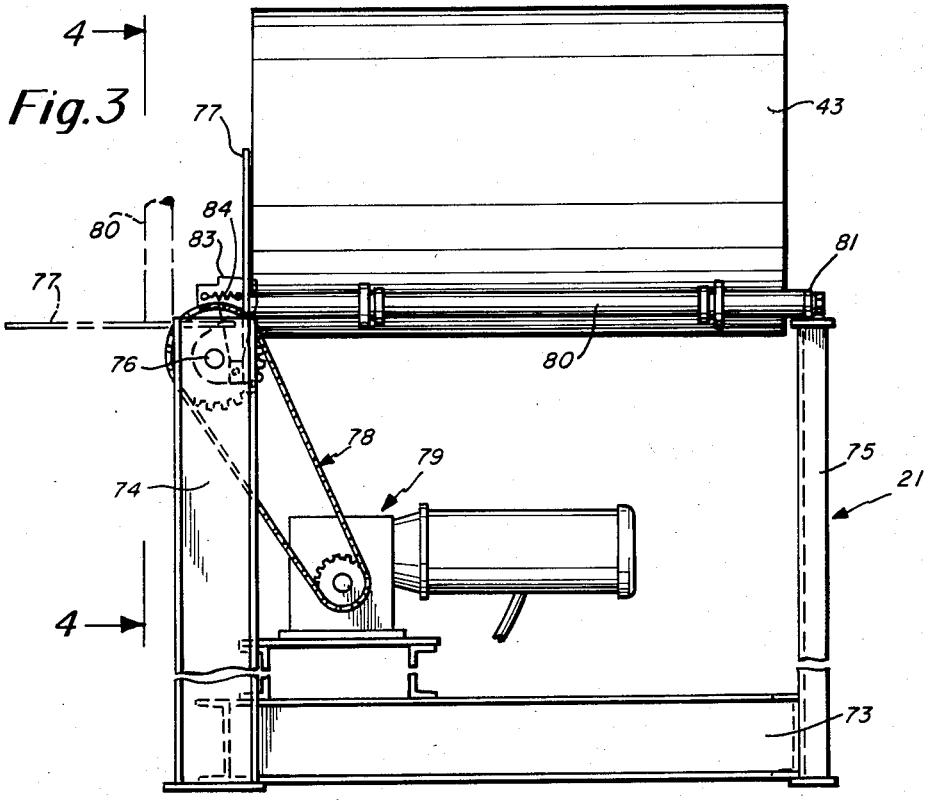
FIG. 3 is a side view of the loader.
Figure 10:
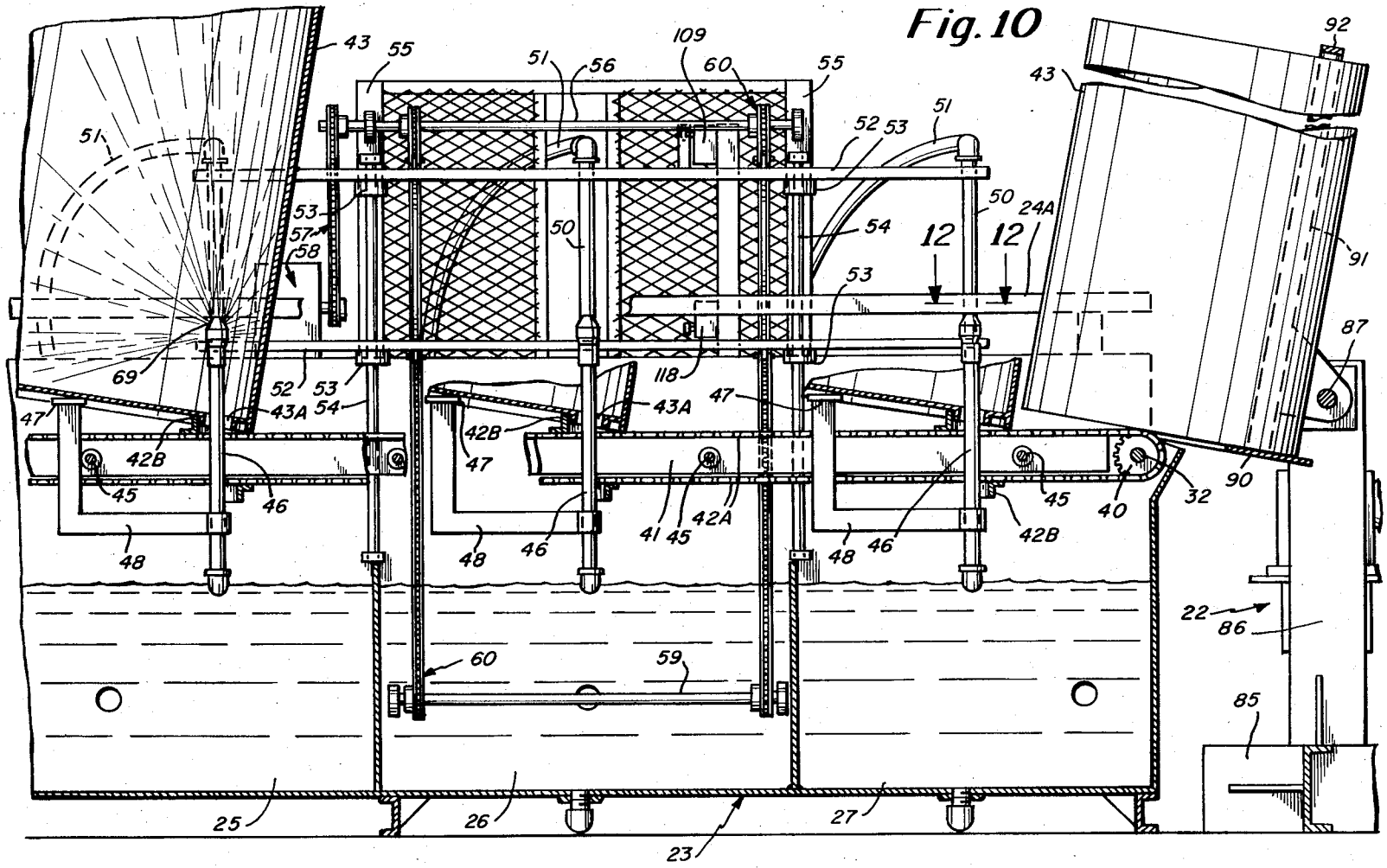
FIG. 10 is a fragmentary lengthwise section of the washer and unloader.
Figure 11:
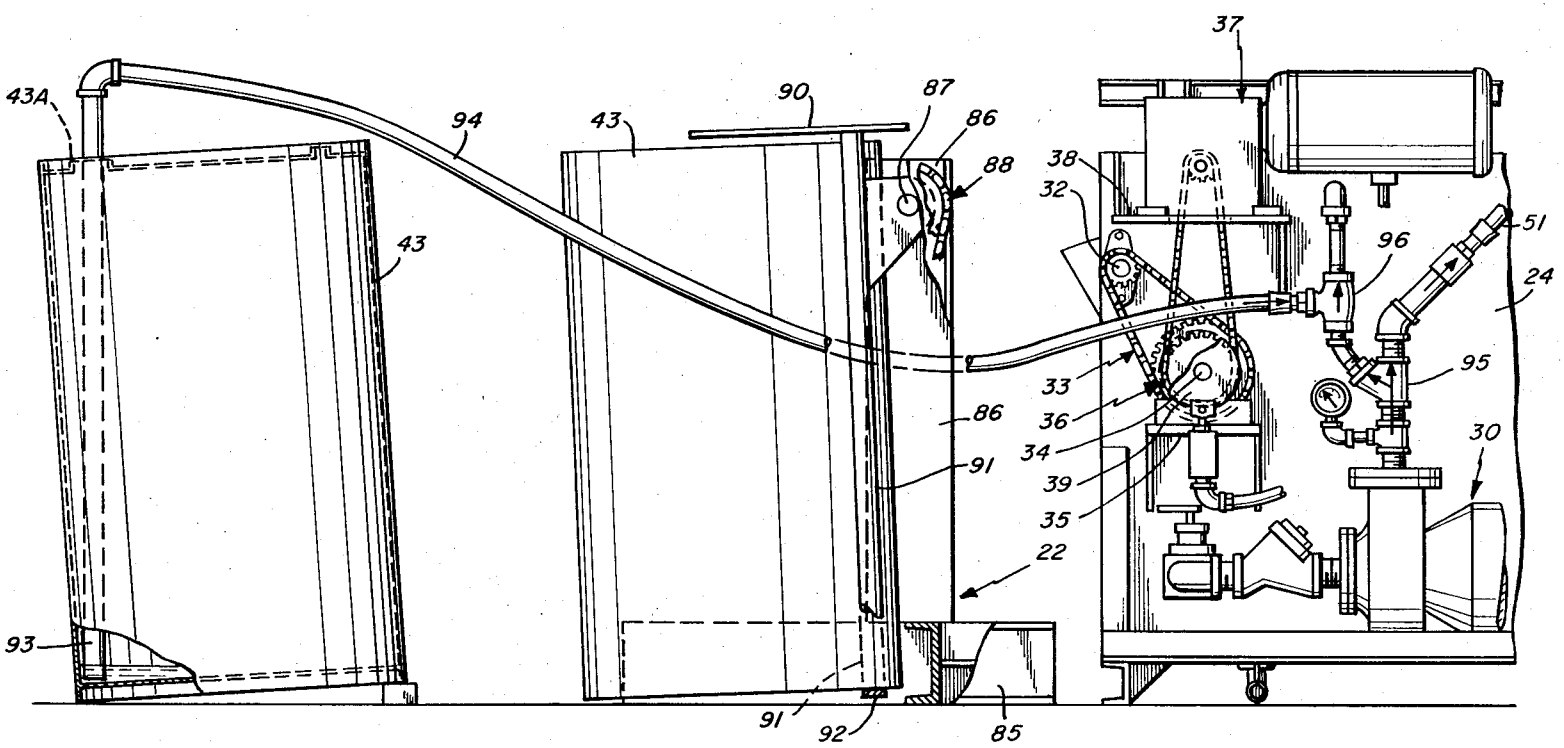
FIG. 11 is a view of the rear end of the reconditioner as viewed from the front illustrating the drying of a drum removed from the unloader.
Figure 12:
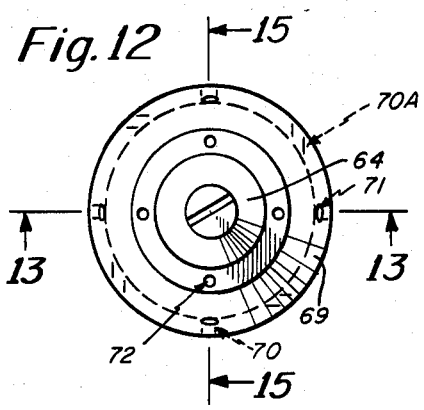
FIG. 12 is a section taken approximately along the indicated line 12—12 of FIG. 10.
Figure 13:
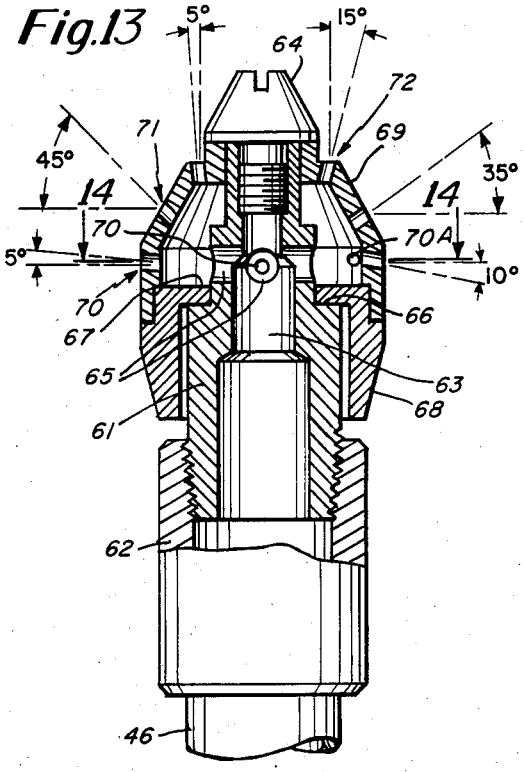
FIG. 13 is a section taken approximately along the indicated line 13—13 of FIG. 12.
Figure 14:
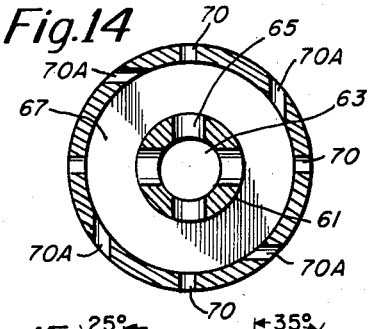
FIG. 14 is a section taken approximately along the indicated line 14—14 of FIG. 13.

The shafts 31 and 32 are each provided with a pair of spaced sprockets 40, about which and chain supports 41 are trained the chains 42A of the drum conveyor, generally indicated at 42, which chains are interconnected by members 42B each in the form of a shallow V disposed in the upper conveyor course to open towards the unloader 22. The function of the V-shaped members 42B, see FIGS. 2 and 10, is to engage the bungs 43A of drums 43 placed head downwardly on supports 44 which extend from end-to-end of the washer 20, one on each side of the conveyor 42 and which and the chain supports 41 are connected to the sides of the shell 24 by cross members 45. By means of such engagement of the V-shaped members 42B with the bungs 43A the drums are pulled forwardly along a predetermined path with the bungs held centered relative to the conveyor 42.

The conveyor 42 is advanced by uniform steps, each such as to advance each drum 43 from a loading position to an operative position or station relative to the tank 25, successively to operative positions or stations relative to subsequent tanks and finally to an unloading position. The length of each step may be varied as required by the diameters of barrels by means of the cam 39.

Each step of the conveyor 42 is interrupted by a dwell of a predetermined interval adequate for the washing and rinsing of the interiors of the drums and their removal and replacement.

In order that the liquids may be effectively applied to interiors of the drums, a straight, vertically disposed spray nozzle 46 of substantial length and a lifter 47 both dimensioned and positioned below the conveyor 42 for passage upwardly between the chains 42A, are provided in each of the ranks with each nozzle 50 so located at each station that at the end of each step, a V-shaped conveyor member 42B is so stationed above each tank that a drum 43 carried thereby has its bung 43A in vertical alignment with a nozzle 46. Each lifter 47 is spaced rearwardly with respect to the associated nozzle 46 and is connected thereto by an arm 48 of a length such as to underlie the head of such a drum rearwardly of its transverse center line.

During each dwell, the nozzles and lifters are raised between the conveyor chains 42A with each nozzle 46 entered through the bung 43B of a drum 43, if present, and its interior sprayed and with the associated lifter 47 tilting such a drum forwardly both to maximize spraying efficiency and to minimize the amount of liquid entrapped therein when that drum is carried forwardly during the next step. In practice and by means subsequently detailed all the nozzles and lifters are raised together if a drum is present at any station but no water is discharged through the nozzle at any station where no drum is present. Before the next step is initiated, the spraying is terminated and the nozzles and lifters are returned to their inoperative positions below the conveyor 42.

Figure 9:
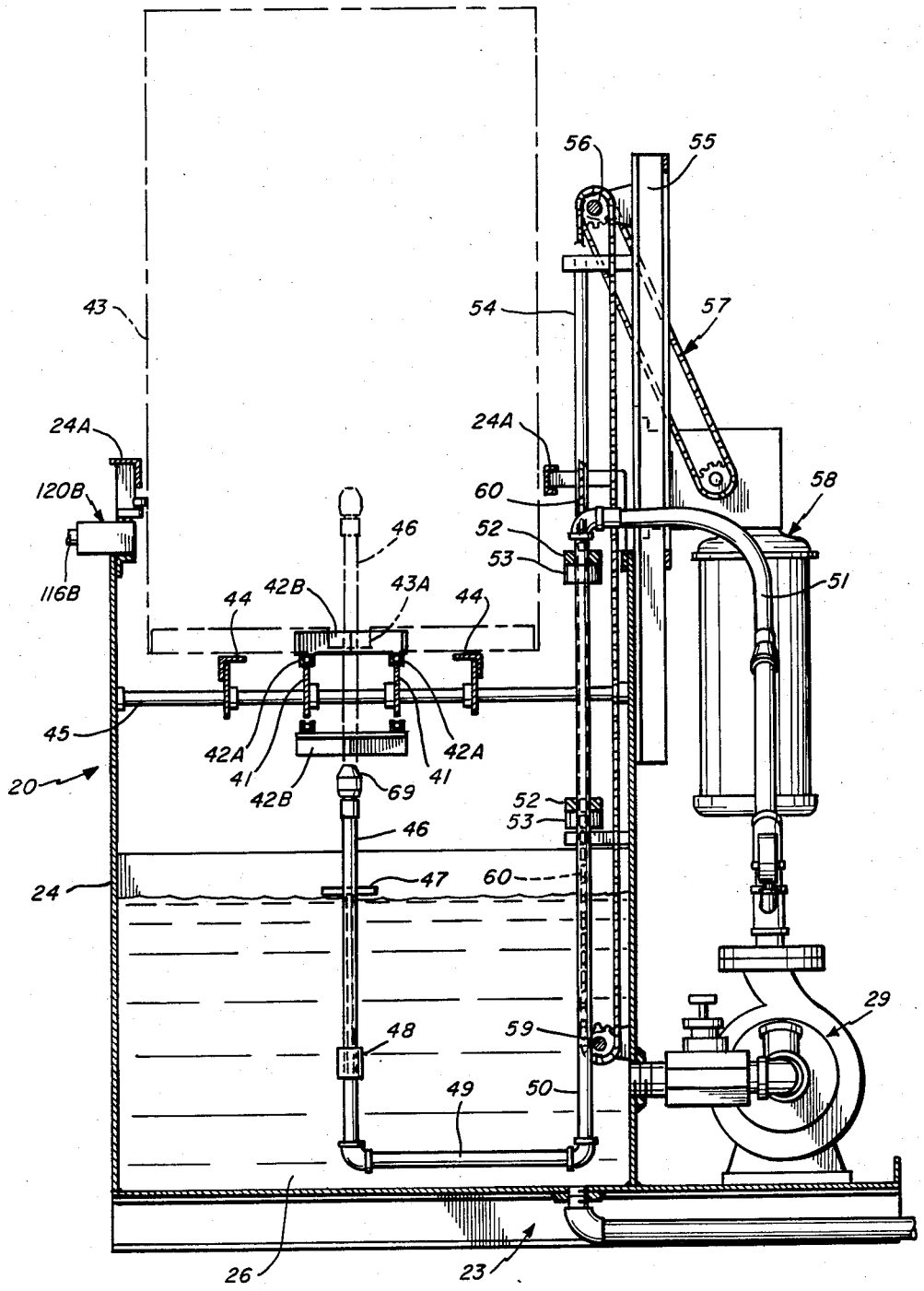
FIG. 9 is a section, on an increase in scale, taken approximately along the indicated line 9—9 of FIG. 7.

In order that the nozzles and lifters may all be reciprocated together between their inoperative and operative positions, each nozzle 46, see FIGS. 7–10, is connected by a rigid transverse conduit section 49 to a rigid vertical conduit section 50 which extends, close to the front wall of the shell 24, above the upper edge thereof with its upper end connected by a length of hose 51 to the appropriate one of the pumps, the pump unit 29 in FIG. 9. The hose lengths 51 are such as to enable the vertical travel of the nozzles and lifters between their operative and inoperative positions to be accommodated.

In order to effect such vertical travel, see FIG. 9 and 10, the pipe sections 50 are interconnected by vertically spaced lengthwise supports 52 which are held by bearing units 53 slidable on guide rods 54. The lower ends of the guide rods 54 are secured to the interior of the front wall of the shell 24 and their upper ends are connected to uprights 55 attached to the outside of the shell and extending a substantial distance above the front guide rail 24A.

A shaft 56 is rotatably supported by the uprights 55 and is driven by means of a chain and sprocket connection 57, see FIG. 9, with the drive shaft of a gear box and reversible motor unit generally indicated at 58 mounted on the front of the shell 24. A shaft 59 is rotatably supported by the front wall of the shell 24 on the inner surface thereof within the tank 26 and the shafts 56 and 59 are interconnected by two chain and sprocket connections generally indicated at 60 with the upper end of each chain of the connection 60 attached to the upper support 52 and its other end attached to the lower support 52, see FIG. 9. From the foregoing, it will be apparent that as the motor of the unit 58 is run first in one direction and then the other, the nozzles and lifters are reciprocated between their two positions.

Each spray nozzle 46 has, see FIGS. 12–15, a spindle 61 attached by a coupling 62 to the upper nozzle end with the spindle having an axial bore 63 closed at its upper end by a cap 64 and having a series of transverse ports 65 above a shoulder 66 which supports the inwardly disposed shoulder 67 of the base 68 of the rotatable spray head 69. The spray head 69 is shown as having three vertically spaced series of spray ports 70, 71, and 72 with the ports 70A of the lowermost series 70 so inclined with respect to an included horizontal plane that liquid discharged therethrough effects the rotation of the spray head 69. As will be apparent by reference to FIGS. 13 and 14, the several spray ports are so variously inclined with reference to vertical planes that, as the spray head turns, the spray is effectively directed against the entire interiors of tilted drums.

Before describing the controls of the apparatus, the loader 21 and the unloader 22 will next be described and particular reference is first made to FIGS. 3–6.

The loader 21 consists of a base 73 provided with a pair of transversely spaced uprights 74 next to the infeed end of the reconditioner 20 and a single, central upright 75 at the opposite end of the base 73. A shaft 76 is rotatably supported by the uprights 74 and a U-shaped holder 77 has its closed end fixed on the shaft to turn therewith, such turning effected by means of a chain and sprocket connection 78 between the shaft 76 and the drive shaft of the gear box reversible motor unit, generally indicated at 79.

The holder 77 has two transversely spaced shafts 80 disposed at right angles thereto and provided with spaced wheels 80A. The shafts 80 are connected at their other ends by a cross tie 81 shown in FIG. 3 as resting on the upright 75 which is the position of the loader 21 when a drum 43 is to be placed on the rollers 80 with its bung end towards the reconditioner 20.

It should be noted that the heads of drums 43, typically have, in addition to their bungs 43A, a diametrically opposite vent plug 43B. The plug 43B is relatively small as compared to the bung 43A for the vent is about five-eighths of an inch in diameter whereas bungholes are typically two inches in diameter.

Figure 4:
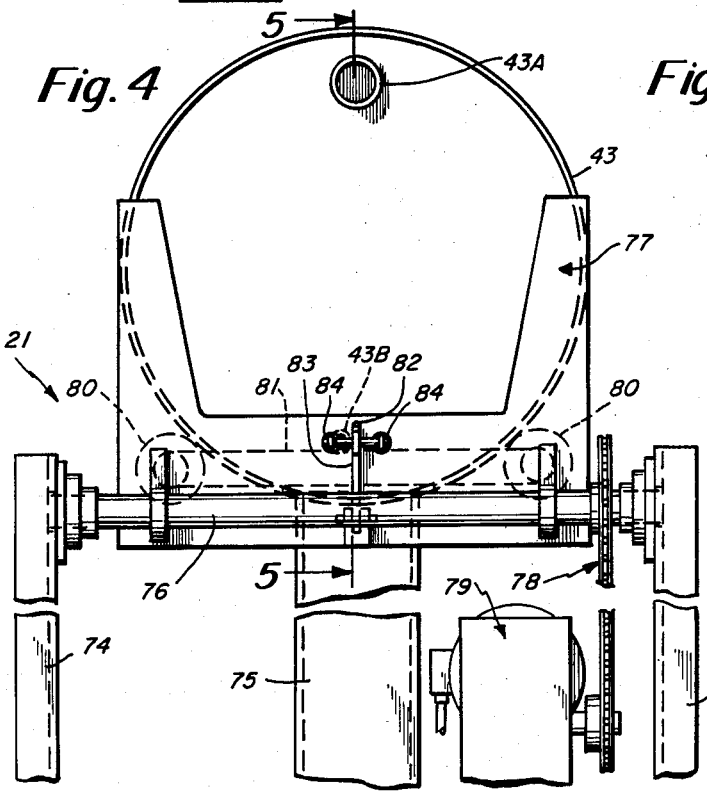
FIG. 4 is a view of the loader, on an increase in scale taken approximately along the indicated line 4—4 FIG. 3.
Figure 5:
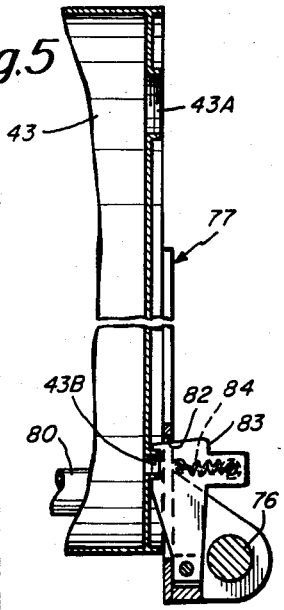
FIG. 5 is a view taken approximately along the indicated line 5—5 of FIG. 4.
Figure 6:
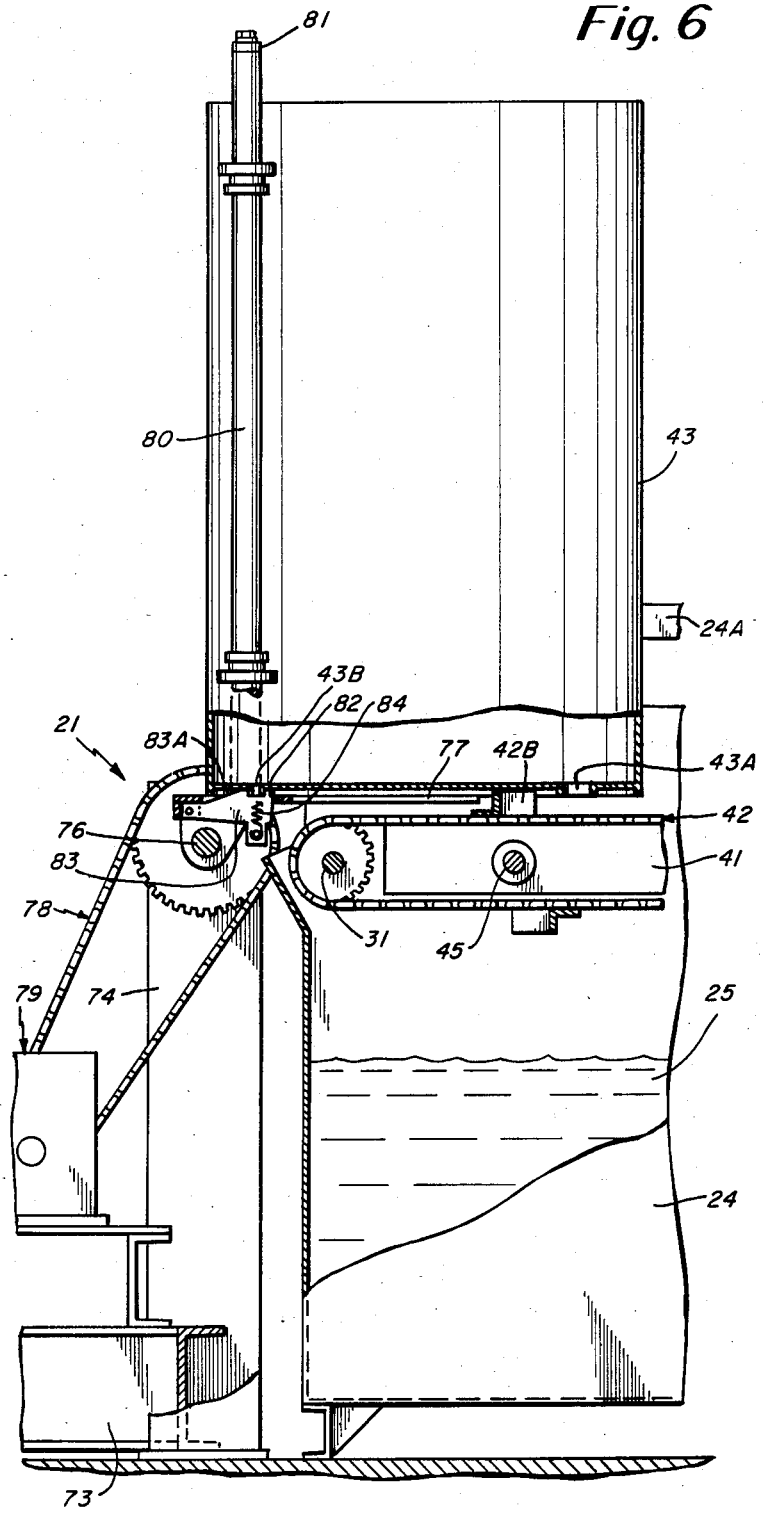
FIG. 6 is a side view of the loader positioned over the infeed end of the conveyor holding a drum for engagement by the conveyor.
Figure 7:
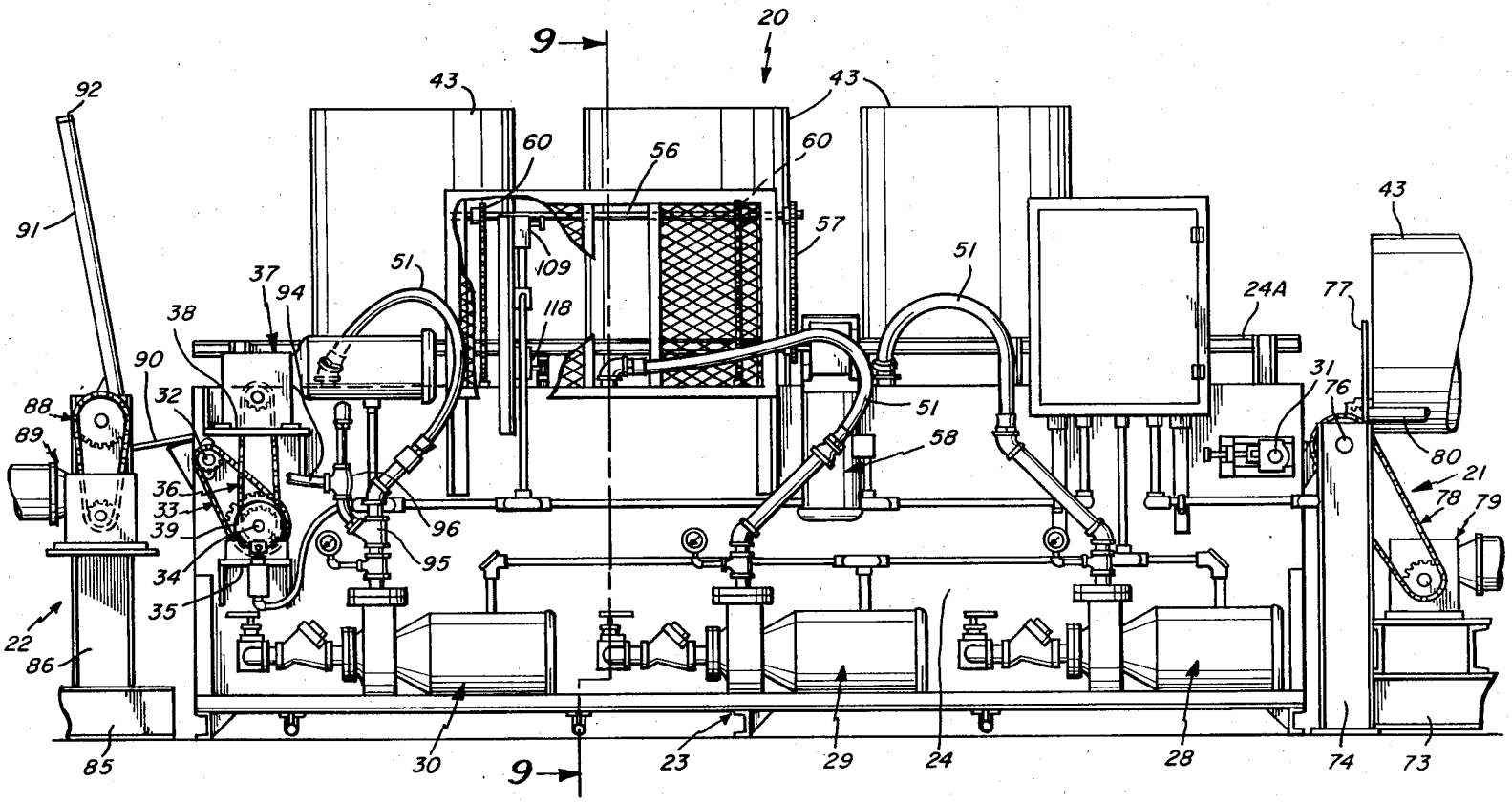
FIG. 7 is a view of the opposite side or front of the apparatus with the drums positioned as they are during conveyor travel.

This fact is taken advantage of to ensure that each drum entrant of the reconditioner 20 is positioned with its head down and its bung 43A forward and located to be caught by the appropriate one of the V-shaped conveyor members 42B by providing the closed end of the holder 77 with a central slot 82, see FIGS. 4 and 5, and pivotally mounting a locator 83 on the face thereof that is proximate to the reconditioner 20. The locator 83 is under the influence of springs 84 yieldably holding the locator 83 in a position in which it protrudes through the slot 82 to be engaged by a vent plug 43B when a drum is turned to an appropriate extent on the supporting rollers 80. As viewed in FIG. 4, the bung 43A is then in an approximately twelve o'clock position. The reversible unit 79 is then operated to swing the drum upwardly and forwardly until the sides of the holder 77 rest on the supports 44 and holds the drum until the appropriate one of the V-shaped conveyor members 42B engages the bung 43A and pulls the drum from the holder 77. It will be noted that the locator 83 has a cam surface 83A, see FIG. 5, which causes the locator 83 to be depressed by the drum rim to relieve the drum as the drum starts forwardly. When the drum is free of the holder 77, the unit 79 is reversed to reestablish the FIG. 3 position of the loader 21.

The unloader 22, see FIGS. 1, 2, 7, 10, and 11 consists of a base 85 having a pair of transversely spaced uprights 86 adjacent the outfeed end of the reconditioner 20 and in support of a shaft 87 with a chain and sprocket connection 88 with the drive shaft of the gear box reversible motor unit 89 mounted on the base 85. The closed end of a U-shaped holder 90 is attached to the shaft 87 to be swung as the shaft turns and is provided with spaced parallel drum supporting members 91 positioned at right angles to the holder 90. The other ends of the members 91 are interconnected by a retainer 92.

With the holder 90 of the unloader positioned as it is in FIG. 10, a drum 43, after the final rinse, is pulled into a position in which it slides along the then inclined holder 90 against the members 91. The unit 89 is then operated to swing the holder 90 clockwise, as viewed in FIGS. 1, 2, and 10, until it reaches the position shown in FIGS. 1 and 11 during which movement the drum has been held by the retainer 92 against endwise movement. It will be noted that when a drum 43 has been placed on the floor, its bung 43A is upwardly disposed and the retainer 92 causes the removed drum to tilt forwardly.

To ensure that no water remains in an unloaded drum, a suction tube 93 is provided adapted to be inserted through the bung 43A into the lowermost point of a tilted, washed and rinsed drum enabling residual water to be quickly withdrawn. The suction tube 93 is connected by a length of hose 94 to a suitable source of suction, see FIG. 7, which is provided by having the pump unit 30 outlet include a Y 95. One branch of the Y 95 includes the nozzle hose 51 and the other branch includes a venturi 96 to which the hose 94 is connected and which discharges directly into the tank 27. It is preferred, see FIG. 11, that a drum be thus dried after its removal from the unloader 22.

Figure 16:
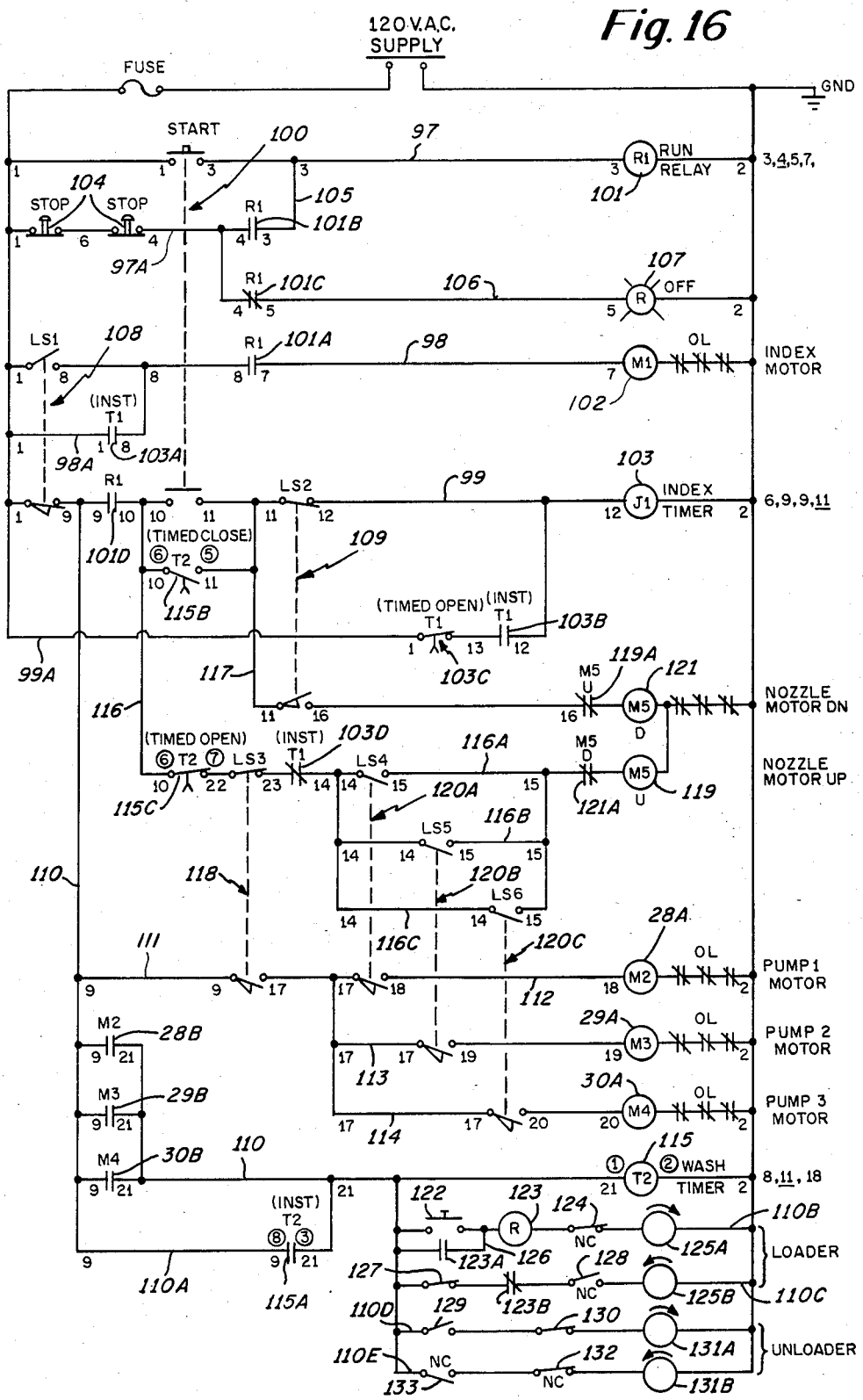
FIG. 16 is a schematic view of the circuitry.

While the operation of the reconditioner 20, the loader 21 and the unloader will be apparent from the foregoing, reference is now made to FIG. 16 in which the circuitry is schematically illustrated by which their operations are automatically effected.

The circuitry of the reconditioner 20 will first be detailed with the circuit from a 120 volt AC source including three leads 97, 98, and 99 with each having an associated parallel lead, the leads 97A, 98A, and 99A, respectively. The leads 97 and 99 are controlled by a normally open starting switch 100 with the lead 97 including a relay 101, the lead 98 provided with the normally open relay switch 101A and the coil 102 which, when energized starts the motor of the conveyor indexing unit 37 and the lead 99 has the index timer 103.

The parallel lead 97A is provided with normally closed stop switches 104 and has branches 105 and 106 with the branch 105 connected to the lead 97 and provided with the normally open switch 101B of the relay 101 thus to provide a holding circuit therefor when the switch 100 is released. The branch lead 106 is provided with the normally closed relay switch 101C and a lamp 107 indicating the power is available but not utilized and placed out of service when the relay 101 is energized.

A limit switch 108 has a first position established at the end of each step or index in which it is open with reference to the lead 98 and closed with reference to the lead 99 and a second position established when each index or step is started in which the lead 98 is closed and the lead 99 is opened. The associated parallel lead 98A has a normally open switch 103A of the timer 103. The lead 99 is also provided with a normally open relay switch 101D and a limit switch 109 closed when the nozzles 46 are down.

With the limit switch 108 closed with reference to the lead 99 and the limit switch 109 is also closed, with respect to the lead 99 the timer 103 is energized closing its switch 103A in the lead 98A and its normally open switch 103B in the parallel timer lead 99A which is also provided with a normally closed timer switch 103C. With the timer switch 103A closed, the coil 102 is energized and the conveyor 42 thus started. The timer switches 103A and 103C are timed to close for a brief interval such that the start of a conveyor index will result in the second position of the limit switch 108. When the switch 103B times out, the timer 103 is reset for the next cycle. On the completion of a step, the original position of the limit switch 108 is again established.

If a drum 43 is present at any of the three wash and rinse positions, the nozzles 46 and lifters 47 are all raised and the motor of the pumping unit associated with each position, if a drum 43 is present, is operated.

To that end, the lead 99 has a lead 110 between the limit switch 108 and the relay switch 101D and a branch lead 111 including parallel leads 112, 113, and 114 for the coils 28A, 29A, and 30A, respectively, by which the motors of the pumping units 28, 29, 30, respectively, are placed in service. The lead 110 is closed to the dwell timer 115 whenever any of the parallel, normally open switches 28B, 29B, and 30B of the coils 28A, 29A, and 30A, respectively, is closed. A holding lead 110A includes the normally open switch 115A of the adjustable dwell timer 115 which is closed until the timer 115 times out.

The lead 99 also includes parallel leads 116 and 117 between which the starting switch 100 is located and which are interconnected when the normally open timer switch 115B is closed by the adjustable timer 115.

The lead 116 is provided with the normally closed switch 115C of the dwell timer 115 the opening of which is timed thereby. The lead 116 and the lead 111 are controlled by a limit switch 118 which is closed with respect to the lead when the nozzles and lifters are down and then opened with respect to the lead 111 with their positions reversed when the nozzles and lifters are raised. The lead 116 is also provided with the normally closed switch 103D of the index timer 103 whereby the lead 116 is open whenever the conveyor is indexing.

The lead 116 is connectable by means of parallel leads 116A, 116B, and 116C to the coil 119 by which the reversible motor of the unit 58 is caused to operate in a direction raising the nozzles and lifters. The parallel leads 116A, 116B, and 116C have normally open limit switches 120a, 120B, and 120C, respectively, each so located at the appropriate one of the three stations that it is closed by a drum 43 if then present at that station.

The limit switches 120A, 120B, and 120C are also in control of the parallel leads 112, 113, and 114, respectively, and are normally open with respect thereto but are closed to effect the operation of the pumping unit or units associated with the station or stations at which a drum is present.

The lead 117 is also under the control of the limit switch 109 and is closed when the nozzles and lifters are in their raised positions. The leads 116 and 117 are interconnected by a normally open switch 115B of the dwell timer 115 which times the closing of the lead 117 to coil 121 by which the motor of the unit 58 is reversed, then to return the nozzles and lifters into their down positions. It will be noted that the lead 117 has the normally closed switch 119A of the coil 119 and that the lead 116 has the normally closed switch 121A of the coil 121.

Figure 15:
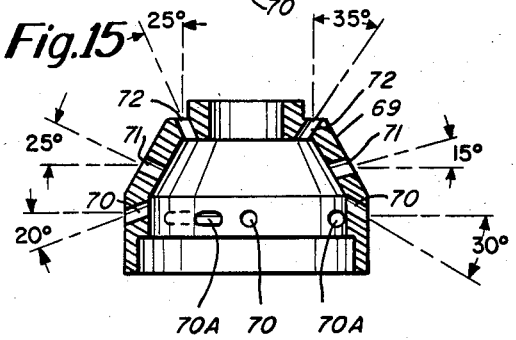
FIG. 15 is a section taken approximately along the indicated line 15—15 of FIG. 12.

It is generally desired that the loader 21 and the unloader 22 be automatically operated and the circuitry of FIG. 15 provides for such operation.

To that end, the lead 110 has a first branch lead 110B which includes a manually operated starting switch 122 positioned on the loader 21 to be closed when a drum is properly positioned thereon, a relay 123 and a normally closed switch 124 on the reconditioner 20 opened when the loader is so positioned on the washer that the loaded drum will be engaged and pulled forwardly by the conveyor 42. The lead 110B also includes the coil 125A by which the reversible motor of the unit 79 is operated in a direction to effect loading. A holding lead 126 for the relay 123 includes the normally open switch 123A thereof.

The second branch lead 110C of the lead 110 includes a normally closed switch 127 open when the loader 21 is positioned to receive a drum and the coil 125B by which the motor of the unit 79 is reversed. The lead 110C is also provided with the normally closed relay switch 123B and the normally closed switch 128 closed when a drum is removed from the unloader 21 by the indexing conveyor.

The unloader 21 is operated in a manner such that its normal position is that in which it receives a drum as an index or step is completed. To that end, the lead 110 has parallel branch leads 110D and 110E.

The branch lead 110D has a normally open switch 129 closed when the unloader receives a drum, a normally closed switch 130 open when a drum is placed on the floor or other support, and the coil 131A by which the reversible motor of the unit 89 is operated in an unloading direction until the switch 130 is opened.

The branch lead 110E has a normally closed switch 132 opened when the unloader has been returned to its normal position, a normally closed switch 133 held open by the drum being unloaded and the coil 131B by which the motor of the unit 89 is reversed.

As the reversing does not occur until the unloaded drum is removed from the unloader 21, the drum may first be drained by the use of the suction tube 93. Alternatively, the drum may be removed immediately and such draining effected as illustrated by FIG. 2.

The operation of the apparatus has been detailed with the exception of the motor circuitry which is conventional for a 230 to 460 V supply.

The apparatus has been described with particular reference to its use in subjecting the interior of drums first to a washing treatment, then to a first rinse followed by a final rinse with drums removed by the unloader 22 then dried by means of a suction tube.

One of the advantages of the invention is that as the three stations are independent of each other and have their own pumping units, numerous cleaning options are available such as the following: (1) washing, rinsing, and air drying; (2) washing-rinsing with a final treatment of which a steam treatment is but one example; (3) pre-washing, washing and rinsing; and (4) a steam treatment followed by washing and rinsing.

Little change is required to enable such options to be practiced. For example, if air drying as a final treatment is wanted, the pump and motor unit 37 is not used and the nozzle of the final station connected to a suitable source of air under pressure. Similarly, if a steam treatment is wanted at any station, a suitable steam source is connected to the nozzle at that station.

I claim:

1. Apparatus for reconditioning the interiors of drums of the type having a bung in one end, a straight row of uniformly spaced stations, a drum conveyor having infeed and outfeed ends and provided with a series of V-shaped bung engaging and centering members spaced apart a distance equal to the spacing between the stations and extending transversely of the conveyor to an extent substantially greater than the diameter of the bungs with their apices trailing and in said path, said conveyor having a straight, horizontal path through said stations, a drum support in a fixed position at said infeed end of the conveyor for a drum supported thereby with its bung end downwardly and with the bung in that portion of the bung end which is to be the leading portion thereof when conveyed through said stations and substantially in the path of said members and in a position to be engaged and held centered by one of said members as said conveyor advances towards said outfeed end and then to be so connected to the conveyor as to be removed from the support thereby and advanced therewith through said stations with each centered bung in said path, means to effect a conveyor stop at each station for a predetermined dwell period with the bung of any conveyed drum in a predetermined position with respect thereto, means to effect the continued advance of said conveyor after a dwell interval whereby said conveyor is advanced by steps, a series of nozzles in a vertical plane inclusive of the path of the centered bungs, one nozzle for each station, means operable during a dwell interval to reciprocate each nozzle in a vertical plane inclusive of said predetermined bung positions between a first position below said conveyor directly below the appropriate one of said predetermined bung positions and a second raised position in which said nozzle extends upwardly through the bung hole of a drum if present at the station at which said nozzle is located, fluid delivery means, one for each station and connected to the nozzle thereof to deliver fluid therethrough if a drum is then present and means at each station operable to tilt a drum towards said outfeed conveyor end if present at that station during a dwell interval.

2. The apparatus of claim 1 and a loader adjacent the infeed end of the conveyor, the loader including a base and a drum receiving support connected thereto to swing vertically between first and second positions, said drum receiving support operable in the first position to receive a drum on its side and in alignment with the conveyor with its bung end towards the conveyor with the bung substantially in alignment with the path and substantially in its uppermost position relative to the drum receiving support which also includes a U-shaped holder engageable by the bung end of the drum, in the second position of the drum receiving support, the ends of the U-shaped holder resting on the stationary drum support at the infeed end of the conveyor with the drum vertically positioned with the bung end thereof downwardly and with the bung thereof exposed in said path to be engaged by a centering member of the conveyor.

3. The apparatus of claim 2 in which the drums are of the type also having a vent plug in the bung and diametrically opposite the bung, the support has a pair of drum supporting rollers, and the closed end of the U-shaped support is provided with a stop engageable by the vent plug as the drum is rotated on the rollers then to locate the bung at said substantially uppermost position, said stop releasably holding the drum in the second position of the support until the bung thereof is engaged and advanced by a centering member of the conveyor.

4. The apparatus of claim 3 and operating means including a reversible drive operable to swing the support of the loader between the first and second positions thereof and control means to effect the operation of the operating means in a manner such that the reversible drive is operable to place a drum on the drum support at the infeed end of the conveyor only during a dwell interval.

5. The apparatus of claim 1 and an unloader adjacent the outfeed end of the conveyor, said unloader including a base, a drum support connected thereto to swing along a vertical path between first and second positions, said drum support including a U-shaped holder at one end, a pair of intermediate members engageable by side portions of a drum and a drum retainer at the opposite end of the drum support, the drum support, in the first position thereof, having the ends of the U-shaped member positioned with the outfeed end of the conveyor between them and with the U-shaped member downwardly inclined away from the conveyor thus to slidably receive a drum being discharged from the outfeed end thereof and in the second position of the drum support of the unloader, the drum is deposited in a substantially vertical position, with its bung downwardly.

6. The apparatus of claim 5 and operating means including a reversible drive to swing the drum support between the first and second positions and control means for the operating means operable to place the drum support in the first position at the end of each dwell interval.

7. The apparatus of claim 1 and a timer in control of station stops and operated in response to the presence of a drum at any station.

8. The apparatus of claim 7 in which the timer is adjustable.

9. The apparatus of claim 1 and means to adjust the length of said steps.

10. The apparatus of claim 1 in which said nozzle reciprocating means is common to the series of nozzles and also to the drum tilting means.

11. The apparatus of claim 1 in which there is a plurality of fluid delivery means each of which includes a pump and a pump operating motor and a control circuit which includes a conveyor control lead by which the conveyor is advanced and a timer control provided with a timer, said timer control also having first, second and third control leads, limit switch means in control of said conveyor and timer control leads and having a normal first position in which the conveyor lead is closed and the timer lead is opened, a member positioned to hold said limit switch means to control said conveyor and timer leads in the opposite manner when the conveyor has advanced a predetermined step, said conveyor and timer leads each provided with a normally open holding lead closed by said timer, the nozzle reciprocating means includes a reversible motor and the first control lead is connected thereto to effect the operation thereof to lower the nozzles and the second control lead is connected thereto to effect the operation thereof to raise the nozzles, second limit switch means in control of said timer lead and first control leads and having a first position in which the timer lead is open and the first control lead open, said second control lead having parallel, first normally open switches, one for each station and closed if a barrel is there present, said third control lead including parallel leads each of which includes the appropriate one of the pump motors of the fluid delivery means and a normally open motor control switch operable to be closed when the corresponding one of the normally open switches of the second control lead is closed, and said third control lead including normally open switch means closed whenever a pump motor is energized and a fluid delivery timer, said third control lead also having a holding lead held closed by the dwell timer for the duration of the dwell, said first control lead including a normally closed switch opened by said fluid delivery timer and said second control lead having a normally open switch closed by said fluid delivery timer.

12. The apparatus of claim 1 in which the drum support includes drum supporting portions extending lengthwise of the conveyor along each side thereof.

13. The apparatus of claim 1 in which the drum support includes supporting members extending lengthwise of the conveyor on each side thereof and extending to the outfeed end thereof and continuously supporting a drum between said ends.

14. The apparatus of claim 1 and means operable to terminate the operation of any of the fluid delivery means that is in service prior to the withdrawal of the nozzle from the associated drum.

15. The apparatus of claim 1 and means to prevent the operation of the conveyor during a stop and to prevent the operation of the nozzle reciprocating means during a conveyor step.

16. The apparatus of claim 1 in which the fluid delivery means includes a plurality of tanks, one for each station and provided with a fluid delivery pump and a fluid delivery conduit, each fluid delivery conduit includes a U-shaped conduit portion having parallel vertical first and second sections and an intermediate section interconnecting the lower ends of said first and second sections, the first vertical section of each conduit portion slidably supported by the apparatus at one side of the drum conveyor for vertical movement between lower and upper limits corresponding to the first and second positions of the nozzles, said intermediate sections disposed transversely of the apparatus and each second section is in communication with the appropriate one of said nozzles as an aligned continuation thereof, each of the drum tilting means is connected to the appropriate one of the nozzles below the drum entering portion thereof, each fluid delivery conduit also includes a flexible portion effecting communication between the first section of the associated U-shaped portion and the appropriate pump and of a length such as to accommodate the vertical movements of said U-shaped portion and the nozzle reciprocating means includes connections with each of said first sections.

* * * * *